US005398105A

United States Patent [19]

Kuriu et al.

[11] Patent Number: 5,398,105

[45] Date of Patent: Mar. 14, 1995

[54] METHOD OF ELECTROPHOTOGRAPHIC WET REVERSAL DEVELOPMENT

[75] Inventors: Sadao Kuriu; Yuji Takagami, both of Tsukuba, Japan

[73] Assignee: Mitsubishi Paper Mills Limited, Tokyo, Japan

[21] Appl. No.: 34,651

[22] Filed: Mar. 22, 1993

Related U.S. Application Data

[63] Continuation of Ser. No. 707,906, May 30, 1991, abandoned.

[30] Foreign Application Priority Data

| | | | |
|---|---|---|---|
| Jun. 6, 1990 | [JP] | Japan | 2-148409 |
| Jun. 8, 1990 | [JP] | Japan | 2-150740 |
| Jun. 8, 1990 | [JP] | Japan | 2-150741 |
| Jun. 8, 1990 | [JP] | Japan | 2-150742 |
| Jun. 8, 1990 | [JP] | Japan | 2-150743 |

[51] Int. Cl.[6] ..... G03G 15/10

[52] U.S. Cl. ..... 355/256; 118/662; 355/245; 355/261

[58] Field of Search ..... 355/77, 245, 255, 256, 355/257, 261; 118/654, 659, 662; 430/31, 36, 49, 100, 103, 902; 346/160

[56] References Cited

U.S. PATENT DOCUMENTS

| | | | |
|---|---|---|---|
| 3,176,652 | 12/1961 | Mott et al. . | |
| 3,176,653 | 4/1965 | Hansen et al. . | |
| 3,203,395 | 8/1965 | Liller et al. . | |
| 3,435,802 | 4/1969 | Nail et al. . | |
| 3,576,623 | 4/1971 | Snelling et al. . | |
| 3,703,399 | 10/1970 | Susumu Tanaka et al. . | |
| 3,892,481 | 7/1975 | Schaefer et al. | 355/256 X |
| 3,916,827 | 11/1975 | Grant et al. . | |
| 4,325,627 | 4/1982 | Swidler et al. | 355/256 |
| 4,342,823 | 8/1982 | Grant et al. | 355/256 X |
| 4,521,101 | 6/1985 | Suzuki et al. | 118/662 X |
| 4,525,441 | 6/1985 | Takahata et al. | 430/31 X |
| 4,565,759 | 1/1986 | Tsutsui | 430/49 X |
| 4,728,983 | 3/1988 | Zwadlo et al. | 346/160 |
| 4,785,327 | 11/1988 | Landa et al. | 355/256 |
| 4,804,994 | 2/1989 | Sasaki et al. | 355/251 |

(List continued on next page.)

FOREIGN PATENT DOCUMENTS 2052577 5/1971 Germany .

(List continued on next page.)

OTHER PUBLICATIONS

Official Action of the German Patent Office dated May 12, 1992 and Translation.

*Primary Examiner*—A. T. Grimley
*Assistant Examiner*—Sandra L. Brasé
*Attorney, Agent, or Firm*—Cushman, Darby & Cushman

[57] ABSTRACT

This invention relates to a method for electrophotographic wet reversal development comprising charging an electrophotographic photoreceptor comprising a substrate and a photosensitive layer coated thereon, exposing the electrophotographic photoreceptor to form an electrostatic latent image on the surface of the photosensitive layer, and developing the electrostatic latent image by carrying the electrophotographic photoreceptor through a wet reversal developing device having a developing electrode in substantially a linear form having a projected width of 30 mm or less and applying a bias voltage to said developing electrode. Usually, the bias voltage applied is 80% or more of the surface potential of the photoreceptor and the development is carried out by passing the photoreceptor at a rate of 0.5–20 m/min through the developing device. This method produces images with less edge effect and excellent tone reproduction. The developing electrode is simplified resulting in improved maintainability.

14 Claims, 4 Drawing Sheets

U.S. PATENT DOCUMENTS

| | | | |
|---|---|---|---|
| 4,827,309 | 5/1989 | Kato | 355/256 |
| 4,882,248 | 11/1989 | Yamada et al. | 430/49 |
| 4,901,114 | 2/1990 | Parker et al. | 430/31 X |
| 4,907,532 | 3/1990 | Mikelsons et al. | 118/659 |
| 4,994,342 | 2/1991 | Nakayama et al. | 430/49 |
| 5,017,968 | 5/1991 | Oikawa | 355/256 X |
| 5,057,389 | 10/1991 | Nakayama et al. | 430/49 |

FOREIGN PATENT DOCUMENTS

| | | |
|---|---|---|
| 3717162 | 3/1959 | Japan . |
| 387758 | 12/1959 | Japan . |
| 46-39405 | 11/1971 | Japan . |
| 52-2437 | 1/1977 | Japan . |
| 57-12985 | 3/1982 | Japan . |
| 57-161863 | 10/1982 | Japan . |
| 58-2854 | 1/1983 | Japan . |
| 58-2860 | 2/1983 | Japan . |
| 58-118658 | 7/1983 | Japan . |
| 59-12452 | 1/1984 | Japan . |
| 59-49555 | 3/1984 | Japan . |
| 59-83174 | 5/1984 | Japan . |
| 59-177572 | 10/1984 | Japan . |
| 59-212850 | 12/1984 | Japan . |
| 59-212851 | 12/1984 | Japan . |
| 60-164757 | 8/1985 | Japan . |
| 60-179751 | 9/1985 | Japan . |
| 60-185962 | 9/1985 | Japan . |
| 60-185963 | 9/1985 | Japan . |
| 60-252367 | 12/1985 | Japan . |
| 61-116364 | 6/1986 | Japan . |
| 61-116365 | 6/1986 | Japan . |
| 62-217256 | 9/1987 | Japan . |
| 62-231266 | 10/1987 | Japan . |
| 62-231267 | 10/1987 | Japan . |
| 62-232660 | 10/1987 | Japan . |
| 63-178258 | 7/1988 | Japan . |
| 63-179368 | 7/1988 | Japan . |
| 63-226668 | 9/1988 | Japan . |
| 1261659 | 10/1989 | Japan . |

METHOD OF ELECTROPHOTOGRAPHIC WET REVERSAL DEVELOPMENT

This is a continuation of application Ser. No. 07/707,906, filed on May 30, 1991, which was abandoned upon the filing hereof.

BACKGROUND OF THE INVENTION

The present invention relates to a method of electrophotographic wet reversal development and in particular, to a method of electrophotographic wet reversal development by which overall uniform development with little edge effect and with excellent tone reproduction can be carried out.

An electrophotographic photoreceptor used as a printing plate is obtained by coating a photoconductive material dispersed or dissolved in a binder on an aluminum sheet subjected to sand blasting and anodizing as a support.

The electrophotographic photoreceptor is made into a printing plate through a charging step, an exposing step, a developing step, and a fixing step or, for some construction of photoreceptor, is made into a printing plate through a dissolving-out step and a gumming step after the fixing step as mentioned, for example, in Japanese Patent Kokoku Nos. 37-17162, 38-7758, and 46-39405 and Japanese Patent Kokai Nos. 52-2437, 57-161863, 58-2854, 58-28760, 58-118658, 59-12452, 59-49555, 62-217256, 63-226668, and 1-261659.

Plate making machines for obtaining printing plates include so-called contact printing system in which an original and an electrophotographic photoreceptor brought into close contact with each other are exposed, so-called projection system in which an original is projected to an electrophotographic photoreceptor through a lens, and scanning exposing system in which an image information of an original is converted to electric signal and an electrophotographic photoreceptor is exposed thereto with laser beam. All of these systems involve positive exposure and negative exposure and there are normal development and reversal development for development.

In general, the reversal development in electrophotography causes larger edge effect than the normal development. In order to diminish the edge effect, it is effective to put a developing bias electrode close to an electrophotographic photoreceptor, but since a bias voltage is applied to the developing bias electrode, there is the fear of shortcircuiting, and the electrode cannot be so close to the photoreceptor. Furthermore, since the distance between the developing bias electrode and the electrophotographic photoreceptor is short, there may occur failure in transportation or there may be caused damage of the surface of the electrophotographic photoreceptor. Thus, the distance between the developing bias electrode and the electrophotographic photoreceptor is usually set at 1–5 mm. Length of developing bias electrode of conventional electrophotographic wet developing apparatuses is set about 100–300 mm.

Another method for diminishing the edge effect is to raise bias voltage, but according to this method, the negative portion of dots is destroyed and the resulting image is poor in tone reproduction.

The developing bias voltage of conventional electrophotographic wet developing apparatuses is set at several ten percents of the surface potential of the electrophotographic photoreceptor. When the developing bias voltage is set at such level, because the surface potential of photoreceptor is higher than the developing bias voltage in the non-image portion, the toner particles in the developer are developed on the developing bias plate and a mass of the developed toners generate a voltage. Since the sum of the voltage generated from this mass of toners and the developing bias voltage is applied to the electrophotographic photoreceptor as a new developing bias voltage, there also occur the problems of obliteration of negative portion of dots and of the image becoming bigger.

Furthermore, when toner is electrically deposited in a large amount on the developing bias electrode, the developing bias voltage is not normally applied to cause troubles in images and so, the toner deposited on the electrode must be periodically removed and a large manpower must be consumed for maintenance.

SUMMARY OF THE INVENTION

An object of the present invention is to provide a method of electrophotographic wet reversal development by which an image having little edge effect and excellent in tone reproduction can be obtained.

Another object of the present invention is to provide a method of electrophotographic wet reversal development which makes it possible to simplify the developing device and to improve maintenance.

Still another object of the present invention is to provide an apparatus for electrophotographic wet reversal development which can produce a good image by avoiding partially uneven concentration of the developer stored in the developing zone.

The objects of the present invention can be attained by making the developing bias electrode substantially linear and carrying out development under application of bias voltage to this bias electrode.

The range of making the developing bias electrode substantially linear is such that a projected width of this electrode is 30 mm or less, preferably 20 mm or less. The developing bias electrode may be made of any materials as far as they are electrically good conductors. For example, any metals can be used.

The range of bias voltage applied to the bias electrode in the method of the present invention is preferably 80% or higher, more preferably 100–500% of the surface potential of the electrophotographic photoreceptor, but this may be set depending on charge quantity or polarity of toner and developing speed and cannot be generically determined.

In practicing the method of the present invention, carrying rate of the photoreceptor is 0.5–20 m/min, preferably 1–10 m/min.

As the binder for photosensitive layer of the electrophotographic photoreceptor used in the present invention, mention may be made of, for example, styrene-maleic anhydride copolymer, styrene-maleic anhydride half ester copolymer, maleic acid copolymer, vinyl acetate-crotonic acid copolymer, and acrylic resins and phenolic resins having an acid value, and the like.

As the photoconductive materials of the photosensitive layer of the electrophotographic photoreceptor used in the method of the present invention, there may be used, for example, inorganic photoconductive materials such as zinc oxide, titanium oxide, and cadmium sulfide and the following various organic photoconductive materials.

Aromatic tertiary amino compounds such as triphenylamine, diphenylbenzylamine, di-(β-naphthyl)benzylamine, and diphenylcyclohexylamine.

Aromatic tertiary diamino compounds such as N,N,N',N'-tetrabenzyl-p-phenylenediamine, N,N,N',N'-tetrabenzylbenzidine, 1,1'-bis(4-N,N-dibenzylaminophenyl)ethane, 2,2-bis(4-N,N-dibenzylaminophenyl)butane, and 4,4'-bis(di-p-tolylamino)-1,1,1-triphenylethane.

Aromatic tertialy triamino compounds such as 4,4',4''-tris(diethylaminophenyl)methane, 4-dimethylamino-4,4''-bis(diethylamino-2,2''-dimethyltriphenylmethane.

Condensation products such as condensation products of aldehydes and aromatic amines, reaction products of tertiary aromatic amines and aromatic halides, poly-p-phenylene-1,3,4-oxadiazole, and reaction products of formaldehyde and condensed polycyclic compounds.

Metal-containing compounds such as 2-mercaptobenzothiazole zinc salt, 2-mercaptobenzoxazole lead salt, 2-mercapto-6-methoxybenzimidazole lead salt, S-hydroxyquinoline aluminum salt, and 2-hydroxy-4-methylazobenzene copper salt.

Polyvinylcarbazole compounds such as polyvinylcarbazole, halogen-substituted polyvinylcarbazole, vinylcarbazole-styrene copolymer, and vinylanthracenevinylcarbazole copolymer.

Heterocyclic compounds such as 1,3,5-triphenylpyrazoline, 1-phenyl-3-(p-dimethylaminostyryl)-5-(p-dimethylaminophenyl)pyrazoline, 1,5-diphenyl-3-styrylpyrazoline, 1,3-diphenyl-5-styrylpyrazoline, 1,3-diphenyl-5-(p-dimethylaminophenyl)pyrazoline, 3-(4'-dimethylaminophenyl)-5,6-di(4''-methoxyphenyl)-1,2,4-triazine, 3-(4'-dimethylaminophenyl)-5,6-dipyridyl-1,2,4-triazine, 2-phenyl-4-(4'-dimethylaminophenyl)-quinazoline, and 6-hydroxy-2,3-di(p-methoxyphenyl)-benzofuran.

Phthalocyanine pigments, quinacridone pigments, indigo pigments, cyanine pigments, perylene pigments, bisbenzimidazole pigments, quinone pigments, azo pigments, and the like.

As the supports for the electrophotographic photoreceptors used in the method of the present invention, preferred are metallic sheets such as aluminum sheet, zinc sheet, magnesium sheet, copper sheet, and iron sheet. Furthermore, there may also be used polymeric films such as polyester, cellulose acetate, polystyrene, polycarbonate, polyamide, and polypropylene, synthetic papers, and coated papers such as resin-coated papers. In these cases, the surface is preferably subjected to electrically conducting treatment or hydrophilization treatment.

The electrophotographic photoreceptor is produced by dissolving at least one of the above-mentioned binders in a solvent, dissolving at least one of the above-mentioned photoconductive materials therein (if the photoconductive material is not soluble therein, it is dispersed therein by a suitable dispersing machine such as colloid mill, ball mill, homogenizer, or ultrasonic dispersing machine.), if necessary, with addition of a sensitizing dye or a chemical sensitizing agent, and coating the solution or dispersion on the above-mentioned support at a thickness of 1–30 μm.

The solvents include all solvents which can dissolve the binder and can dissolve or disperse the photoconductive material. Examples of the solvents are alcohols such as methanol, ethanol, propanol, butanol, and hexyl alcohol, cellosolves such as methyl cellosolve, ethyl cellosolve, and butyl cellosolve, aromatics such as benzene, toluene, and xylene, cyclic ethers such as dioxane and tetrahydrofuran, esters such as ethyl acetate and butyl acetate, ketones such as acetone, methyl ethyl ketone, and methyl isobutyl ketone, dimethylformamide, dimethyl sulfoxide, and halogenated hydrocarbons. These are selected considering solubility, cost and safety and these solvents may be used singly or in combination of two or more.

When the photoreceptor is used as a printing plate, the toner in the developer is required to be hydrophobic and have ink-receptivity and to have adhesion to the photosensitive layer enough to endure printing. Further, when the printing plate is made by dissolving away the non-image portion with alkalis and/or alcohols, the toner must have resistivity against the dissolving liquid.

Toners which satisfy these conditions include those for liquid development which are prepared by mechanically dispersing colorant pigments or dyes such as carbon black, Cyanine Blue, Nigrosine, and oil dyes in a highly insulating medium together with resins such as rosin, alkyd resin, acrylic resin, and synthetic rubbers which have resistivity against the dissolving liquid by ball mill, attritor, homogenizer or the like and stably imparting a charge to the dispersed particles of the dispersion by adding methallic soaps, amines, higher resin acids, etc. Moreover, there are toners for liquid development which are prepared by previously introducing a vinyl group polymerizable by polymeric reaction into a precursor polymer, polymerizing a monomer in the presence of the precursor polymer to produce a graft copolymer, and coloring the graft copolymer with a dye as mentioned in Japanese Patent Kokoku Nos. 53-54029 and 57-12985.

Furthermore, there may be used, as toners for liquid development, resin dispersions obtained by polymerizing a monomer soluble in a highly insulating medium, but becoming insoluble upon being polymerized, in the presence of a polymer soluble in the highly insulating medium as mentioned in Japanese Patent Kokai Nos. 59-83174, 59-177572, 59-212850, 59-212851, 60-164757, 60-179751, 60-185962, 60-185963, 60-252367, 61-116364, and 61-116365. In addition, there may be suitably used liquid toners as described in Japanese Patent Kokai Nos. 62-231266, 62-231267, 62-232660, 63-178258, and 63-179368.

DETAILED DESCRIPTION

Figure 1:
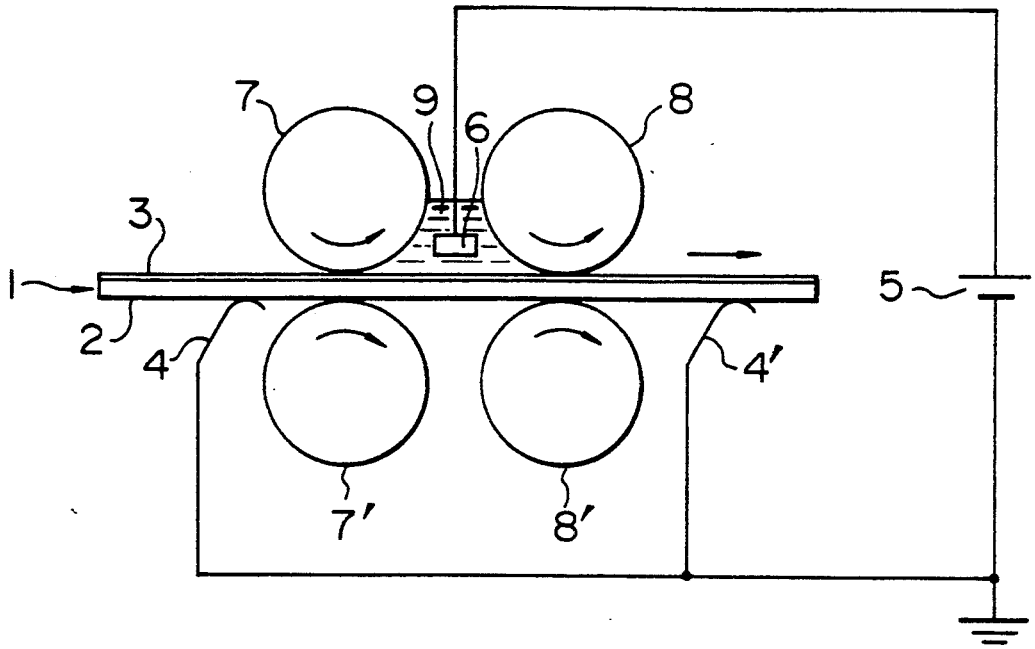
FIG. 1 is a schematic side view of one example of a developing device for carrying out the method of the present invention.
Figure 2:
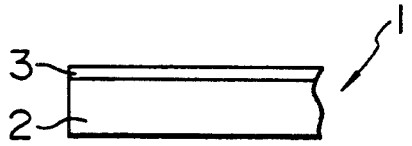
FIG. 2 is a side view of a photoreceptor to which the method of the present invention is applied.

Electrophotographic photoreceptor 1 in FIGS. 1 and 2 comprises support 2 and photosensitive layer 3 formed on the support 2.

Electrophotographic photoreceptor 1 was prepared by coating an electrophotographic photosensitive solution having the following composition on support 2 which was an aluminum sheet having a thickness of 0.3 mm which was subjected to roughening treatment and anodizing treatment by usual methods and drying the photosensitive layer 3. Thus, an electrophotographic lithographic printing plate was obtained. Coating amount of the photosensitive layer after dried was 4.5 $g/m^2$.

| | Part by weight |
|---|---|
| Butyl methacrylate/methacrylic acid copolymer (molecular weight: 50,000 and acid value: 200) | 18 |
| Metal-free phthalocyanine | 4 |
| 1-Butyl acetate | 60 |
| 2-Propanol | 18 |

In FIG. 1, a pair of carrying rollers 7, 7' and a pair of squeeze rollers 8, 8'are arranged on the upper and lower sides, respectively and these rollers are rotated in the directions indicated by the arrows, whereby electrophotographic photoreceptor 1 is horizontally carried from the side of carrying rollers 7, 7' towards the side of squeeze rollers 8, 8', namely, from the left side to the right side in FIG. 1. Carrying speed of electrophotographic photoreceptor 1 was 3.5 m/min. Diameter of the carrying rollers 7, 7' and squeeze rollers 8, 8' was 20 mm, but this is not critical.

A reservoir for developer is formed by carrying roller 7, squeeze roller 8 and electrophotographic photoreceptor 1 and developer 9 is supplied thereto and stored therein. Developing bias electrode 6 is placed in developer 9 stored in the developer reservoir. Developing bias voltage is applied to developing bias electrode 6 from developing bias source 5. Electrical supply pieces 4, 4' are allowed to slidingly contact with support 2 of electrophotographic photoreceptor. The developing bias voltage was as shown in Table 1.

The projected width of developing bias electrode 6 was 0.1 mm, 1 mm, 5 mm, 20 mm, or 30 mm as shown in Table 1. As comparative examples, 50 mm and 100 mm were also employed.

A commercially available electrophotographic wet developer (LOM ED-III, a dispersion of toner particles bearing positive charge in an insulating solvent manufactured by Mitsubishi Paper Mills Ltd.) was used as developer 9.

Distance between center of the carrying rollers 7, 7' and that of squeeze rollers 8, 8' was set by adding the projected width of developing bias electrode and 20 mm to the sum of radiuses of respective rollers.

Photosensitive layer 3 of electrophotographic photoreceptor 1 was positively charged to a surface potential of 300 V by a corona charger (not shown) by conventional method.

Then, photosensitive layer 3 of electrophotographic photoreceptor 1 was subjected to contact image exposure (not shown) through a negative film (Test chart No. 1-T 1975 of Electrophotographic Society). Electrophotographic photoreceptor 1 was carried by a pair of carrying rollers 7, 7' and excess developer was removed by a pair of squeeze rollers 8, 8'. Thereafter, the electrophotographic photoreceptor 1 proceeds to the next step.

Between carrying rollers 7, 7' and squeeze rollers 8, 8', electrophotographic wet reversal development is carried out by the closed circuit of developing bias source 5—developing bias electrode 6—developer 9—photosensitive layer 3—support 2—electrical supply pieces 4, 4'—developing bias source 5.

TABLE 1

| | Projected width of electrode | Bias voltage | Electrophotographic image quality |
|---|---|---|---|
| Example 1 | 0.1 mm | 1200 V | Good. |
| Example 2 | 1 mm | 800 V | Good. |
| Example 3 | 5 mm | 450 V | Good. |
| Example 4 | 20 mm | 300 V | Good. |
| Example 5 | 30 mm | 300 V | Dots were slightly destroyed. |
| Comparative Example 1 | 50 mm | 300 V | Dots were destroyed and edge effect occurred. |
| Comparative Example 2 | 100 mm | 300 V | Dots were destroyed much and edge effect was large. |

The non-image portion of the resulting electrophotographic lithographic printing plate was dissolved away with a dissolving liquid (prepared by diluting 20 parts by weight of aqueous sodium silicate solution and 1 part by weight of potassium hydroxide to 100 parts by weight with water) and lithographic printing was carried out using the lithographic printing plate. Prints of good image quality excellent in tone reproduction could be obtained in Example 1, Example 2, Example 3, and Example 4. Shadow portion of the dots was somewhat destroyed in Example 5, but this was not so severe as to cause troubles in partical use.

On the other hand, shadow portion of the dots was completely destroyed in the prints obtained in Comparative Example 1 and Comparative Example 2 and the prints had no tone reproduction.

Next, explanation will be made on various examples of the developing device for carrying out the method of the present invention.

Figure 3:
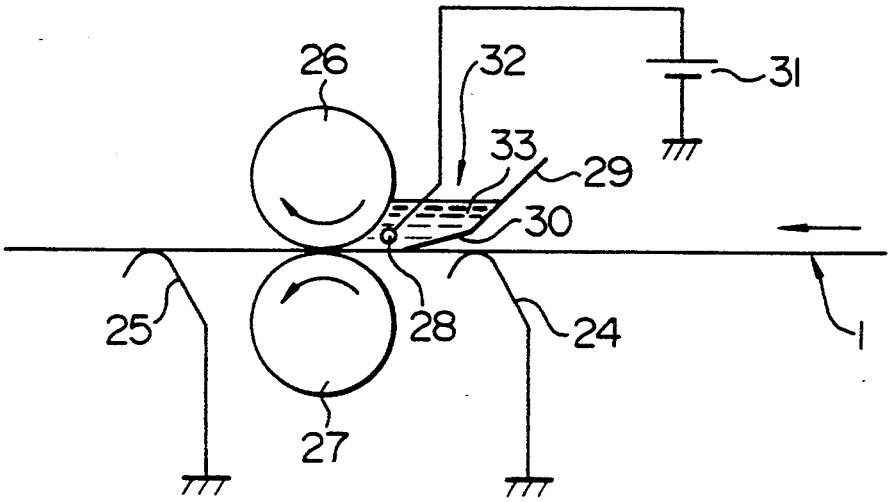
FIG. 3 is a schematic side view of another example of a developing device for carrying out the method of the present invention.

The developing device shown in FIG. 3 has squeeze rollers 26, 27 arranged in pairs on the upper and lower sides, electrical supply pieces 24, 25 arranged on the upstream side and the downstream sides in respect to the above squeeze rollers 26, 27 in the carrying direction of electrophotographic photoreceptor 1, developer blocking member 29 provided on the upstream side and in the vicinity of squeeze roller 26, elastic material 30 comprising a plastic film or a rubber provided in continuity with the lower edge of the developer blocking member 29, developing bias electrode 28 provided between squeeze roller 26 and developer blocking member 29 and elastic material 30, and bias voltage source 31 to apply a bias voltage to the developing bias electrode 28.

Materials for developer blocking member 29 include metals, flexible plastics and the like.

In FIG. 3, when photoreceptor 1 is carried from the right side to the left side, the lower edge of elastic material 30 slidingly contacts with the surface of photoreceptor 1 and furthermore, a pair of squeeze rollers 26, 27 press the photoreceptor 1 from the upper and lower sides to produce a space surrounded by photoreceptor 1, squeeze roller 26, developer blocking member 29, and elastic material 30. This space is used as developer reservoir 32, which is filled with developer 33. Developing bias electrode 28 is placed in the developer reservoir 32 filled with developer 33. Electrical supply pieces 24, 25 arranged before and after squeeze rollers 26, 27 slidingly contact with support 2 (see FIG. 2) of photoreceptor 1.

Each constituting member of the developing device explained hereabove has a given length in the direction perpendicular to the surface of FIG. 3 in correspondence with the width of photoreceptor 1. Concentration of developer 33 is made always uniform by such means as overflowing the developer from both end portions in lengthwise direction of developer reservoir 32 simultaneously with uniformly supplying the developer in the lengthwise direction of developer reservoir 32.

In the example, the projected width of developing bias electrode 28 was 5 mm, which corresponds to 1/10 or less of the width of bias electrode used in conventional electrophotographic wet reversal development. The materials of developing bias electrode 28 can be electrically good conductors and for example, all of metals can be used. Distance between developing bias electrode 28 and photosensitive layer of photoreceptor 1 (see FIG. 2) was set at 2 mm.

A pair of squeeze rollers 26, 27 are rotated in the direction indicated by arrow and photoreceptor 1 is carried from right side to left side in FIG. 3. In the example, carrying speed of photoreceptor 1 was 5 m/min.

By narrowing the width of developing bias electrode 28 in this way, developing time per unit area of photoreceptor decreases and consequently the carrying speed of photoreceptor 1 in developing becomes fast and furthermore, developing bias electrode 28 can be considered to be equivalent to substantially linear electrode with the width in carrying direction of photoreceptor 1 being very narrowed.

A developing bias voltage is applied to developing bias electrode 28 from bias source 31. In the example, the developing bias voltage was 400 V which was considerably higher than the developing bias voltage employed in the conventional reversal developing methods.

Positive charge is imparted to photosensitive layer 3 of photoreceptor 1 by known method using a corona charge which is not shown. The surface potential of photoreceptor 1 was 300 V here.

On the thus positively charged surface of photoreceptor 1 is superposed the above-mentioned negative film, followed by carrying out imagewise contact exposure to form a latent image on the surface of photoreceptor 1. This photoreceptor 1 is led to the developing device shown in FIG. 3 and developer 33 is filled in developer reservoir 32 and photoreceptor 1 is carried by the rotation of squeeze rollers 26, 27 while applying a bias voltage to developing bias electrode 28 from bias source 31. While photosensitive layer 3 of photoreceptor 1 passes between the lower edge portion of elastic material 30 and squeeze roller 26, developer 33 contacts with the photosensitive layer 3 and a bias voltage is applied to developing bias electrode 28 by the closed circuit of bias source 31—developing bias electrode 28—developer 33—photosensitive layer 3—support 2—electrical supply pieces 24, 25—bias source 31 and wet reversal development is carried out. Squeeze rollers 26, 27 squeeze out excess developer 33 deposited on photoreceptor 1. The developed photoreceptor 1 is subjected to the subsequent treating step. Developer 33 after photoreceptor 1 has passed therethrough is recovered in a pan which is not shown and circulated by a pump to be reused for development.

As aforementioned, the developing time required for unit area of photoreceptor 1 is considerably shortened since the carrying speed of photoreceptor 1 is fast, the portion of photoreceptor 1 with which developer 33 contacts is short, and the projected width of developing bias electrode 28 in the carrying direction of the photoreceptor is narrow and the electrode is in substantially linear form. On the other hand, since the bias voltage applied to developing bias electrode 28 is 400 V, namely, is set at higher than 300 V of the surface potential of photoreceptor 1, the toner particles in developer 33 are electrophorectically moved and deposit imagewise on the image portion (zero in charge) of the surface of photoreceptor 1 and thus the desired development can be performed. Furthermore, owing to the short developing time as mentioned above, there are the advantages that toner does not deposit on the non-image portion and besides, edge effect does not occur. On the other hand, when the developing time becomes short, density of the solid portion is insufficient and hence, the density of the solid portion is enhanced by increasing the bias voltage as mentioned above.

The thus formed image was satisfactory with no edge effect. Moreover, the shadow portion of dots was not destroyed and the image was good in tone reproduction.

Figure 4:
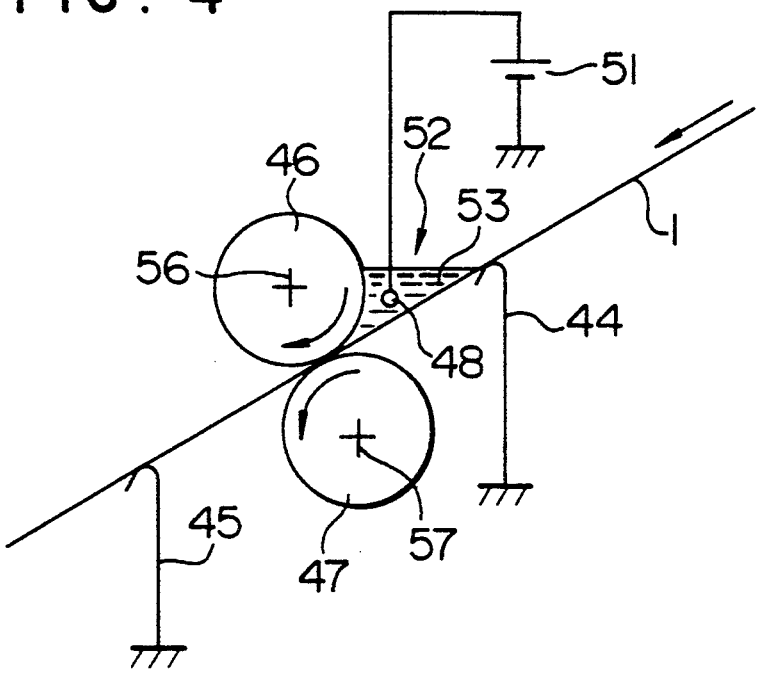
FIG. 4 is a schematic side view of further another example of a developing device for carrying out the method of the present invention.

The developing device shown in FIG. 4 has squeeze rollers 46, 47 arranged in pairs on the upper side and the lower side, electrical supply pieces 44, 45 provided on the upstream side and the down stream side of the squeeze rollers 46, 47 in the carrying direction of electrophotographic photoreceptor 1, developing bias electrode 48 provided on the upstream side of squeeze roller 46 in the carrying direction of the photoreceptor, and bias voltage source 51 for applying bias voltage to the developing bias electrode 48.

Rotating shaft 56 of squeeze roller 46 is slightly shifted to downstream side in the carrying direction of photoreceptor than rotating shaft 57 of the another squeeze roller 47, whereby photoreceptor 1 is carried with an inclination to the horizontal direction. More specifically, it is carried in an inclined direction with the upstream side in the carrying direction of photoreceptor being in the higher position and the lowerstream side being in the lower position. Furthermore, the electrical supply pieces 44, 45 are arranged with differing in their height from each other so that they can slidingly contact with photoreceptor 1 which is carried in the inclined direction. The angle of inclination of photoreceptor 1 is not critical, but is set within the range of about 5° to 80° in order to form a suitable developer reservoir. This was set at 30° here.

In FIG. 4, when photoreceptor 1 is carried from upper right side towards lower left side, squeeze rollers 46, 47 press photoreceptor 1 from upper and lower sides to form a space in the form of nearly reversed triangle by the photoreceptor carried in the inclined direction and squeeze roller 46. This space is used as developer reservoir 52 and this developer reservoir 52 is filled with developer 53. The developing bias electrode 48 is placed in the developer reservoir 52 filled with developer 53. Electrical supply pieces 44, 45 arranged before and after squeeze rollers 46, 47 slidingly contact with support 2 of photoreceptor 1.

Each of the constituting members of the developing device explained above has a given length in the direction perpendicular to the surface of FIG. 4 in correspondence to the width of photoreceptor 1. Concentration of developer 53 is made always uniform by such means as overflowing developer 53 from both end portions in the lengthwise direction of developer reservoir 52 simultaneously with uniformly supplying the developer in the lengthwise direction of developer reservoir 52.

In case of using such developing device, it is also possible to obtain the same actions and advantages as mentioned above by setting the conditions such as developing bias electrode 48, rollers 46, 47, carrying speed of photoreceptor 1, and bias voltage in the same manner as above.

The developing devices shown in FIG. 5 and FIG. 6 have squeeze rollers 66, 67 arranged in pairs on the upper and lower sides, electrical supply pieces 64, 65 provided on the upstream side and on the downstream side of the squeeze rollers 66, 67 in the carrying direction of electrophotographic photoreceptor 1, developer feeding container 72 provided below the carried photoreceptor 1 and on the upstream side of squeeze roller 66 in the carrying direction of the photoreceptor, developing bias electrode 68 provided at the side part of upper outlet 75 of the developer feeding container 72, and bias source 71 for applying a bias voltage to the developing bias electrode 68.

The above photoreceptor 1 is carried with photosensitive layer 3 facing downward. Electrical supply pieces 64, 65 are provided above the carried photoreceptor 1 so that they slidingly contact with support 2 of photoreceptor 1. Developer is introduced into the developer feeding container 72 from its lower part and overflows from upper outlet 75 to adhere to photosensitive layer 3 of photoreceptor 1. The developing bias electrode 68 is provided in the passage of the overflowing developer. Container 74 which receives the overflowing developer is provided underneath both the developer feeding container 72 and squeeze roller 67.

Figure 5:
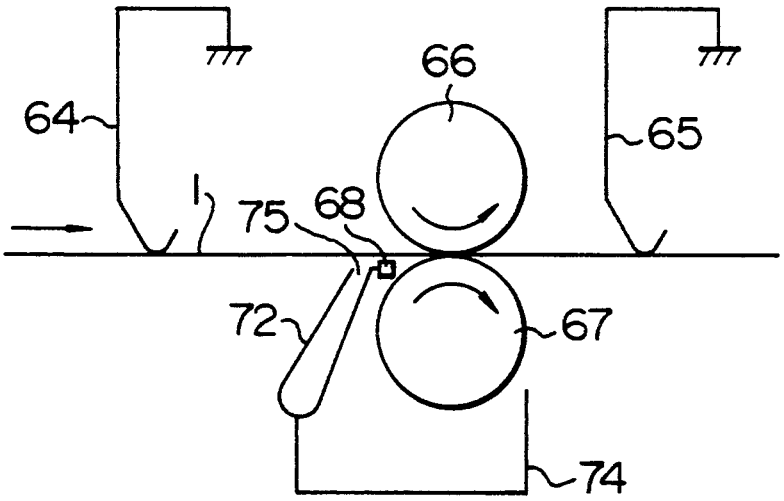
FIG. 5 is a schematic side view of still another example of a developing device for carrying out the method of the present invention.
Figure 6:
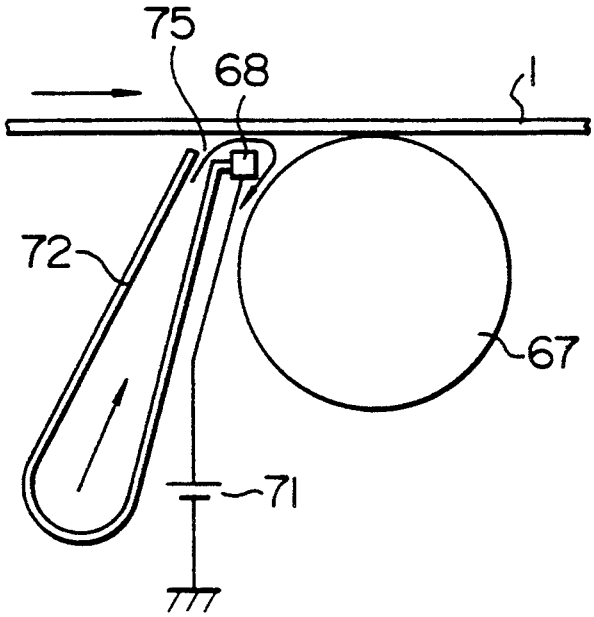
FIG. 6 is a side view of enlarged essential part of the developing device.

Each of the constituting members of the developing devices explained above has a given length in the direction perpendicular to the surface of FIGS. 5 and 6 in correspondence to the width of photoreceptor 1. The developer uniformly overflows from upper outlet 75 of developer feeding container 72 in the lengthwise direction of the outlet 75 and fresh developer having a constant concentration is always uniformly fed to the surface of photosensitive layer 3 of photoreceptor 1.

On the surface of photoreceptor 1 imparted with positive charge was superposed a negative film and imagewise contact exposure is carried out to form a latent image on the surface of photoreceptor 1. This photoreceptor is led to the developing device shown in FIGS. 5 and 6 and is carried by rotation of the pair of squeeze rollers 66, 67 with introducing the developer from the lower part of developer feeding container 72 and overflowing the developer from upper outlet 75 of developer feeding container 72 and with applying a bias voltage to developing bias electrode 68 from bias source 71. While photosensitive layer 3 of photoreceptor 1 passes the position of the developer which overflows from upper outlet 75 of developer feeding container 72, the developer contacts with photosensitive layer 3 and a bias voltage is applied to developing bias electrode 68 by the closed circuit of bias source 71—developing bias electrode 68—developer—photosensitive layer 3—support 2—electrical supply pieces 64, 65—bias source 71 and thus, wet reversal development is performed. Squeeze rollers 66, 67 squeeze out the excess developer deposited on photoreceptor 1. The thus developed photoreceptor 1 is subjected to the treatment of the subsequent step. The developer through which photoreceptor 1 has passed is recovered by a pan which is not shown and circulated by a pump to be reused for development.

In this example, too, the same action and effects as in the aforementioned example can be obtained by setting the various designing conditions in the same manner as aforementioned.

Figure 7:
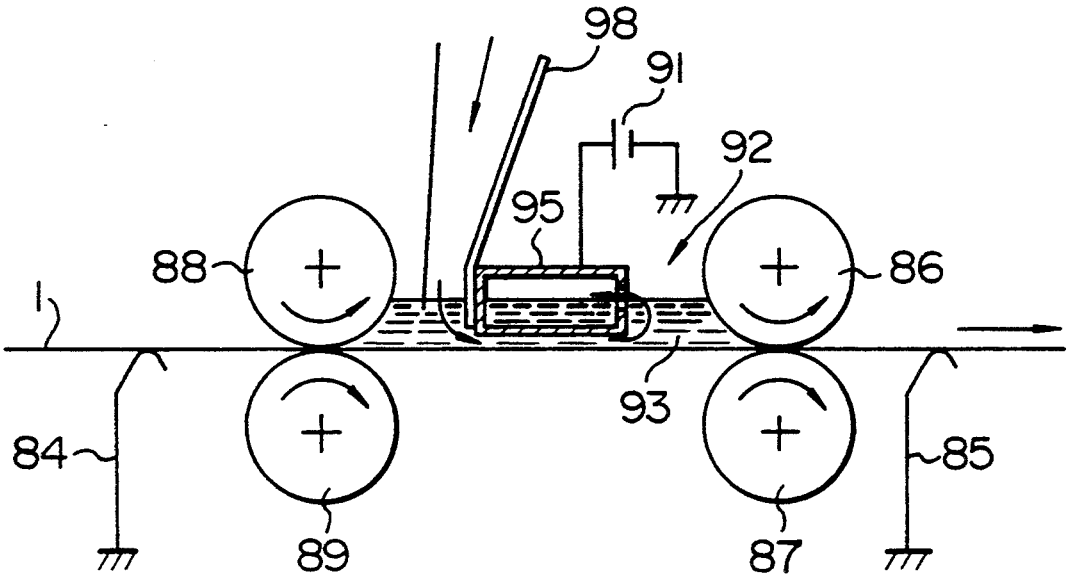
FIG. 7 is a schematic side view of still another example of a developing device for carrying out the method of the present invention.
Figure 8:
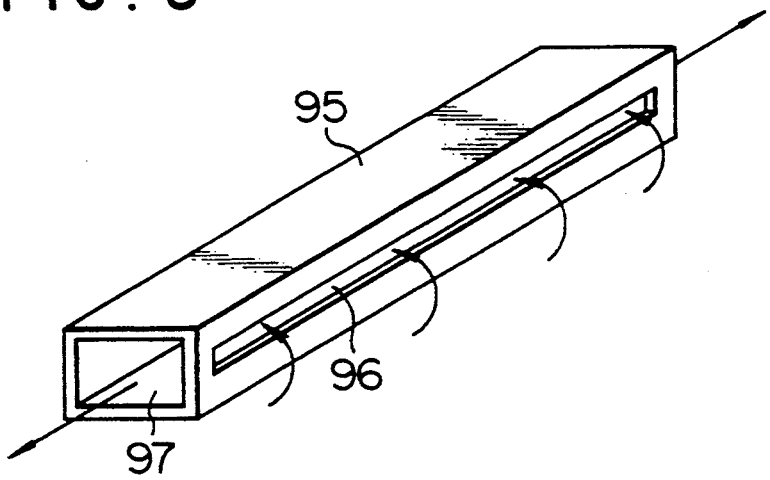
FIG. 8 is an oblique view of a suction box for developer in the developing device.

Next, examples of the developing devices shown in FIGS. 7 and 8 will be explained. In FIG. 7, carrying rollers 88, 89 arranged in pairs on the upper and lower sides are for carrying electrophotographic photoreceptor 1 to the developing zone and the photoreceptor 1 carried to the developing zone by carrying rollers 88, 89 is further carried by squeeze rollers 86, 87 arranged in pairs on the upper and lower sides. Electrical supply piece 84 is provided on the upstream side of carrying rollers 88, 89 in the carrying direction of the photoreceptor and electrical supply piece 85 is provided on the downstream side of squeeze rollers 86, 87 in the carrying direction of the photoreceptor. A space of which the front and rear sides and the bottom are surrounded by the carried photoreceptor 1 and carrying roller 88 and squeeze roller 86 is formed and this space is used as developer reservoir 92. The liquid developer 93 is fed to developer reservoir 92 from developer feeding gutter 98 and developer reservoir 92 is filled with developer 93.

Developer suction box 95 is provided in developer reservoir 92. Developer suction box 95 extends long in the direction crossing the carrying direction of the photoreceptor at right angles. Moreover, developer suction box 95 has a slit-like suction opening in longer direction for sucking developer 93 in developer reservoir 92 and besides, has at both ends discharging openings 97 for discharging the sucked developer 93 out of developer reservoir 92 as shown in FIG. 8. Developer suction box 95 serves also as a developing bias electrode and is applied with bias voltage from bias source 91.

Each of the constituting members of the developing zone explained above has a given length in the direction perpendicular to the surface of FIG. 7 in correspondence to the width of photoreceptor 1.

The width, in the carrying direction of the photoreceptor, of developer suction box 95 which also serves as a developing bias electrode is extremely smaller than the width of bias electrode used in the conventional electrophotographic wet reversal developing device. Materials of developer suction box 95 which also serves as a developing bias electrode can be electrically good conductors and, for example, all of metals can be used. Distance between developer suction box 95 and photosensitive layer 3 of photoreceptor 1 was set at 2 mm here.

Carrying rollers 88, 89 and squeeze rollers 86, 87 are rotated in the direction indicated by arrows as shown in FIG. 7 and photoreceptor 1 is carried from the left side to the right side in FIG. 7. In the example, carrying speed of photoreceptor 1 was set at 5 m/min.

Narrowing the width of developing suction box 95 which also serves as the developing bias electrode and increasing the carrying speed of photoreceptor 1 in development in this way are eventually the same as shortening the developing time per unit area of photoreceptor 1. Furthermore, the developing bias electrode which is developer suction box 95 can be considered to be equivalent to the electrode of which width in the carrying direction of photoreceptor 1 is much shortened to substantially a linear form.

On the surface of photoreceptor 1 positively charged is superposed a negative film and imagewise contact exposure is carried out to form a latent image on the surface of photoreceptor 1. This photoreceptor 1 is led to the developing device shown in FIG. 7 and is carried by rotation of carrying rollers 88, 89 and squeeze rollers 86, 87 with filling developer reservoir 92 with developer 93 by feeding developer 93 to developer reservoir 92 through developer feeding gutter 98 and with applying a bias voltage to developing suction box 95 from bias source 91. While photosensitive layer 3 of photoreceptor 1 passes developer reservoir 92, the photosensitive layer 3 contacts with developer 93 and a bias voltage is applied to developing suction box 95 by the closed circuit of bias source 91—developer suction box 95—developer 93—photosensitive layer 3—support 2— electrical supply pieces 84, 85—bias source 91 and wet reversal development is performed. Squeeze rollers 86, 87 squeeze out the excess developer 93 deposited on photoreceptor 1. The thus developed photoreceptor 1 is subjected to the treatment of the subsequent step.

The same action and effects as obtained in the aforementioned example can be obtained also when this developing device is used. Developer 93 fed to developer reservoir 92 spreads in the developer reservoir 92 and fills the developer reservoir 92 and is used for development of photoreceptor 1. The excess developer 93 after used for development is sucked into developer suction box 95 from suction opening 96 and is discharged from discharging openings 97 at the both ends of developer suction box 95 out of developer reservoir 92. Since the suction opening 96 is formed in the longer direction of developer suction box 95, namely, in the direction crossing the carrying direction of photoreceptor at right angles, developer 93 which spreads in the direction crossing the carrying direction of the photoreceptor at right angles is uniformly sucked and concentration distribution of developer 93 in the direction crossing the carrying direction of the photoreceptor at right angles is uniformly maintained. As a result, density of the image developed on photoreceptor 1 becomes uniform and thus, good image can be obtained.

Figure 9:
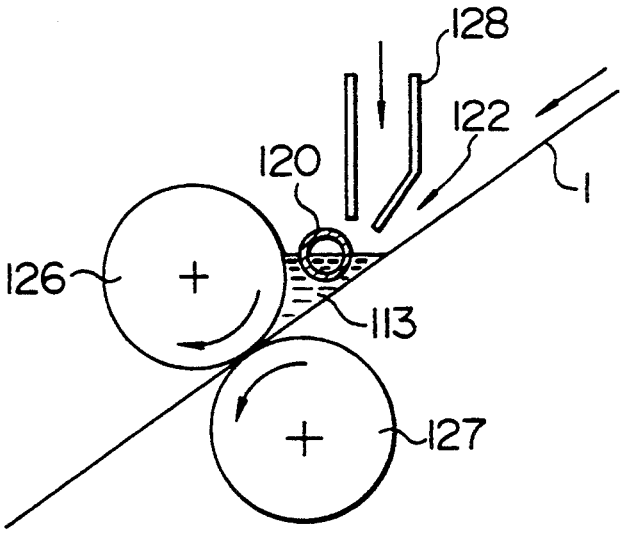
FIG. 9 is a side view of further another example of a developing device for carrying out the method of the present invention.
Figure 10:
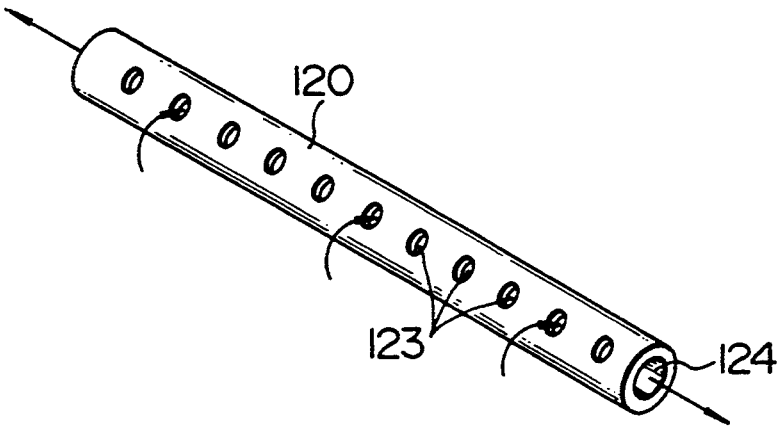
FIG. 10 is an oblique view of a suction box for developer in the above developing device.

Next, example of the developing devices shown in FIGS. 9 and 10 is explained. In FIG. 9, the reference numbers 126 and 127 indicate a pair of squeeze rollers and rotating shaft of the upper squeeze roller 126 is somewhat deviated to the downstream side in the carrying direction of the photoreceptor from the rotating shaft of squeeze roller 127, whereby photoreceptor 1 is carried in the direction inclined to the horizontal direction. More specifically, the photoreceptor is carried in the inclined direction with the upstream side in the carrying direction being higher than the downstream side.

In FIG. 9, when photoreceptor 1 is carried from upper right side to lower left side, squeeze rollers 126, 127 press the photoreceptor 1 from upper and lower sides to form a space of nearly reversed triangle by photoreceptor 1 carried in inclined direction to the horizontal direction and squeeze roller 126. This space is used as developer reservoir 122 and developer 113 is fed to the developer reservoir 122 through developer feeding gutter 128 and the developer reservoir 122 is filled with developer 113. Developer suction box 120 which also serves as a developing bias electrode is provided in developer reservoir 122 filled with developer 113. The developer suction box 120 is formed in the form of circular pipe and has many suction holes in the longer direction for sucking developer 113 in developer reservoir 122 and besides, has discharge openings 124 at both ends for discharging the sucked developer 113 out of developer reservoir 122.

Function of developer suction box 120 in the above example is the same as that of developer suction box 95 in the example shown in FIG. 7 and by sucking developer 113 spreading in developer reservoir 122 from many suction holes 123, concentration distribution of developer 113 is maintained uniformly and consequently, density of the image developed on photoreceptor 1 becomes uniform and good image can be obtained.

Materials of the squeeze rollers of the above various developing devices used for carrying out the present invention are rubbers, plastics and the like for the rollers which contact with the photosensitive layer of the electrophotographic photoreceptor and rubbers, plastics, metals, and the like for the rollers which contact with the support of the photoreceptor.

What is claimed is:

1. A method for making an electrophotographic lithographic printing plate, the method comprising:

charging a sheet-like electrophotographic photoreceptor comprising a metallic substrate and a photosensitive layer coated thereon;

exposing the electrophotographic photoreceptor to form an electrostatic latent image on a photosensitive surface of the photosensitive layer; and developing the electrostatic latent image by linearly carrying the electrophotographic photoreceptor at a rate of 0.5 to 20 m/min. through a wet reversal developing device comprising a developing electrode in substantially a linear form having a projected width of 30 mm or less and by applying a bias voltage of 100 to 500% of a surface potential of the photoreceptor to the developing electrode, the photosensitive surface being opposed to the developing electrode.

2. A method according to claim 1, further comprising the steps of applying developer to the photosensitive surface from a developer reservoir of the wet reversal developing device, the developer reservoir being formed by at least a carried photoreceptor, a squeeze roller which presses the photoreceptor, and a developer blocking member provided in the vicinity of the squeeze roller on an upstream side in the a carrying direction of the photoreceptor, the developing electrode being provided in the developer reservoir so that the developing electrode faces the photosensitive surface of the carried photoreceptor.

3. A method according to claim 1, further comprising the steps of carrying a photoreceptor in a horizontal direction;

and applying a developer to the photosensitive surface from a developing reservoir formed on an upstream side in a carrying direction of the photoreceptor by at least a carried photoreceptor and a squeeze roller which presses the photoreceptor, and the developing electrode being provided in the developer reservoir so that it faces the photosensitive surface of the carried photoreceptor.

4. A method according to claim 1, further comprising the steps of carrying a photoreceptor in a direction which is substantially a right angle to the developing electrode;

and applying a developer to the photosensitive surface from discharge openings on the developing electrode, the wet reversal developing device further comprising a developer reservoir, the developing electrode being provided in the developer reservoir, the developing electrode being provided with suction holes in a longer direction for sucking a developer from the developer reservoir, and the discharge openings being located at end portions of the developing electrode for discharging the developer.

5. A method according to claim 1, further comprising the steps of carrying the photoreceptor at the rate of 1–10 m/min.

6. A method according to claim 1, further comprising the steps of carrying the photoreceptor with the photosensitive surface facing downward and towards a developer feeding container of the wet reversal developing device; and depositing developer from the developer feeding container onto the photosensitive surface of the photoreceptor by overflowing the developer from an upper outlet of the developer feeding container.

7. The method according to claim 1, wherein the step of developing the electrophotographic photoreceptor is conducted by using a developing electrode having a projected width of 20 mm or less.

8. A method for making an electrophotographic lithographic printing plate, the method comprising:

charging a sheet-like electrophotographic photoreceptor comprising a metallic substrate and a photosensitive layer coated thereon;

exposing the electrophotographic photoreceptor to form an electrostatic latent image on a photosensitive surface of the photosensitive layer;

developing the electrostatic latent image by linearly carrying the electrophotographic photoreceptor at a rate of 0.5 to 20 m/min. through a wet reversal developing device comprising a developing electrode in substantially a linear form having a projected width of 30 mm or less and by applying a bias voltage of 100 to 500% of a surface potential of the photoreceptor to the developing electrode, the photosensitive surface being opposed to the developing electrode; and dissolving away the non-image portions of the photosensitive layer on which toner images have been formed during the developing step by using a dissolving solution.

9. The method according to claim 8, further comprising the step of carrying the photoreceptor at the rate of 1 to 10 m/min.

10. The method according to claim 8, wherein the step of developing the electrophotographic photoreceptor is conducted by using a developing electrode having a projected width of 20 mm or less.

11. A method according to claim 8, further comprising the steps of applying developer to the photosensitive surface from a developer reservoir of the wet reversal developing device, the developer reservoir being formed by at least a carried photoreceptor, a squeeze roller which presses the photoreceptor, and a developer blocking member provided in the vicinity of the squeeze roller on an upstream side in the a carrying direction of the photoreceptor, the developing electrode being provided in the developer reservoir so that it faces the photosensitive surface of the carried photoreceptor.

12. A method according to claim 8, further comprising the steps of carrying a photoreceptor in a horizontal direction;

and applying a developer to the photosensitive surface from a developing reservoir formed on an upstream side in a carrying direction of the photoreceptor by at least a carried photoreceptor and a squeeze roller which presses the photoreceptor, and the developing electrode is provided in the developer reservoir so that it faces the photosensitive surface of the carried photoreceptor.

13. A method according to claim 8, further comprising the steps of carrying a photoreceptor in a direction which is substantially a right angle to the developing electrode;

and applying a developer to the photosensitive surface from discharge openings on the developing electrode, the wet reversal developing device further comprising a developer reservoir, a developing electrode being provided in the developer reservoir, the developing electrode being provided with suction holes in a longer direction for sucking a developer from the developer reservoir, and the discharge openings being located at end portions of the developing electrode for discharging the developer.

14. A method according to claim 8, further comprising the steps of carrying the photoreceptor with the photosensitive surface facing downward and towards a developer feeding container of the wet reversal developing device; and depositing developer from the developer feeding container onto the photosensitive surface of the photoreceptor by overflowing the developer from an upper outlet of the developer feeding container.

* * * * *